United States Patent [19]

Snowden

[11] 4,323,524

[45] Apr. 6, 1982

[54] PRODUCTION OF FIBRES

[75] Inventor: Paul Snowden, Redcar, England

[73] Assignee: Imperial Chemical Industries Limited, London, England

[21] Appl. No.: 148,521

[22] Filed: May 9, 1980

Related U.S. Application Data

[63] Continuation-in-part of Ser. No. 92,857, Nov. 9, 1979, abandoned, which is a continuation of Ser. No. 885,344, Mar. 10, 1978, Pat. No. 4,178,336.

[30] Foreign Application Priority Data

| | | | |
|---|---|---|---|
| Mar. 11, 1977 | [GB] | United Kingdom | 10405/77 |
| May 15, 1979 | [GB] | United Kingdom | 16863/79 |
| Feb. 21, 1980 | [GB] | United Kingdom | 05838/80 |

[51] Int. Cl.[3] ..... B22D 23/08

[52] U.S. Cl. ..... 264/8; 264/12; 264/164; 264/236

[58] Field of Search ..... 264/8, 12, 164, 236; 425/8

[56] References Cited

U.S. PATENT DOCUMENTS

| | | | |
|---|---|---|---|
| 2,336,743 | 12/1943 | Manning | 264/DIG. 74 |
| 2,433,000 | 12/1947 | Manning | 264/DIG. 74 |
| 3,920,362 | 11/1975 | Bradt | 264/164 |
| 4,178,336 | 12/1979 | Snowden | 264/8 |

FOREIGN PATENT DOCUMENTS

| | | | |
|---|---|---|---|
| 51-53013 | 5/1976 | Japan | 264/12 |
| 2001578 A | 2/1979 | United Kingdom | 264/8 |

*Primary Examiner*—Jay H. Woo

*Attorney, Agent, or Firm*—Cushman, Darby & Cushman

[57] ABSTRACT

Fibres are produced by centrifugally spinning a formaldehyde resin, e.g. a UF resin, plus catalyst and contacting the spun fibres with a stream of hot dry air to dry the fibres. Cold, humid air is fed to the spinning cup to inhibit premature drying of the resin. The rotation of the cup causes the cold humid air to be thrown out of the cup with the fibres entrained therein. This entrainment serves to retard drying of the fibres while they attenuate.

10 Claims, 10 Drawing Figures

PRODUCTION OF FIBRES

This application is a continuation-in-part of my application Ser. No. 92,857 filed Nov. 9, 1979 now abandoned which in turn was a continuation of my application Ser. No. 885,344 filed Mar. 10, 1978 and now issued as U.S. Pat. No. 4,178,336.

The present invention relates to a process for centrifugally spinning fibres from a liquid formaldehyde resin such as an amino- and/or phenol-formaldehyde resin, particularly a urea formaldehyde resin.

The resin in liquid form, for example an aqueous solution of a urea-formaldehyde resin, mixed with a curing catalyst which allows the resin to have a usefully long pot-life at room temperature but which, at temperatures above 100° C., particularly above 120° C., cures and chemically stabilizes the resin and renders it insoluble in cold water, is fed at a pre-selected (but variable) rate into a spinning-cup or the like rotating at a high preselected (but variable), speed. Purely by way of example, cups having diameters in the range 3" to 5" have been used with rotational speeds of 3000 to 5000 rpm, or higher, e.g. up to 10,000 rpm.

The rotation of the cup causes the resin/catalyst mixture to flow over the inner surface and wall of the cup as an even film and to be spun centrifugally outwards from the rim of the cup or from a plurality of apertures provided at regular intervals in the circumference of the wall of the cup, in the form of individual separate fibres. In order to inhibit drying or reaction of the catalyst/resin mixture at least while in the cup, cold humid air is fed to the interior of the cup. Normally air from the external surroundings of the spinning apparatus may be employed, e.g. ambient air having a temperature below 30° C. and a relative humidity in excess of 50% is suitable. The temperature and humidity of the cold, humid air may be modified as necessary to provide satisfactory spinning but generally the air temperature should be below 40° C. and the air should have a relative humidity above 40%. It will be appreciated that as the air temperature is reduced, the relative humidity need not be so high in order to retard drying of the spun fibres.

The rotation of the cup causes the cold, humid air to be thrown out of the cup with the fibres so that the latter are entrained in an outwardly directed stream of cold humid air (which may be augmented by means of cold humid air flowing downwards from above, and deflected outwards by the spinning cup). The fibres are thus spun outwards from the cup in the presence of outwardly directed cold, humid air currents so that before they are dried or cured, they continue to be drawn out and become attenuated, i.e. stretched, into fibres of smaller diameter. When they have achieved the desired diameter and before they have had a chance to develop into droplets or shot, the fibres are dried and physically stabilized by heat, and transported to a collecting zone.

These heating and transporting steps are carried out by contacting the fibres with a stream of hot, dry air. The hot air is at a temperature sufficient to dry and physically stabilize the fibres. Preferably the hot air is at such a temperature that will heat the fibres above 50° C. but to below 100° C., typically to 65° C. to 70° C., at which temperature the fibres are dried and physically stabilized without, however, causing the catalyst to cure and chemically stabilize them. The temperature of the hot, dry, air is preferably in the range 80° to 270° C., particularly 100° to 220° C. The relative humidity of the hot air is preferably below 50° C. Conveniently the hot, dry, air may simply be ambient air heated to the desired temperature without any drying step.

The hot dry air currents also serve the purpose of supporting the fibres and carrying them to a collecting zone which, in unconfined conditions, would normally be in the form of an annulus having the spinning cup as its centre, but at some distance away from, and below, the cup.

The dried fibres are removed from the collecting zone and then may be cured and chemically stabilized by the catalyst, by heating the fibres, for example in an oven, at over 100° C. until the fibres are insoluble in cold water.

The present invention accordingly provides a process for centrifugally spinning fibres from a formaldehyde resin comprising feeding the resin together with a resin-curing catalyst, which at temperatures above 100° C. will cure and chemically stabilize the resin and render it insoluble in cold water, in liquid form into a spinning cup rotating about a substantially vertical axis, feeding cold, humid air into the cup, the temperature and humidity of the air being such that it inhibits drying and reaction of the resin/catalyst mixture whilst in the cup, the rotation of the cup causing the resin/catalyst mixture to flow as an even film over the inner surface of the cup, and to be spun centrifugally from the outer wall of the cup, in the form of individual, separate fibres entrained in an outwardly directed stream of said cold, humid, air within which said fibres attenuate until they have achieved the desired diameter, contacting the fibres with a stream of hot dry air at a temperature such as to dry the attenuated fibres and to transport them to a collecting zone, and collecting the dry fibres from the collecting zone. The formaldehyde resin is preferably a condensate of an amino compound with formaldehyde. The amino compound is preferably a polyamine, particularly urea and/or melamine. In order that the resin is water soluble, so that it can be fed to the spinning cup as an aqueous solution, the amino compound is preferably urea, alone or in admixture with up to 5% by weight of melamine. Some or all of the amino compound may be replaced by a phenol such as phenol, cresol or resorcinol.

It is preferred that the molar ratio of formaldehyde to phenol and/or amino groups is between 0.6:1 and 1.5:1, preferably between 0.7:1 and 1.3:1.

The curing catalyst, which is preferably added to the resin just before the latter is fed to the spinning cup, should be fed to the spinning cup in liquid form. Where the resin is fed to the cup as an aqueous solution, the catalyst is preferably water soluble and added to the resin solution as an aqueous solution. The catalyst may be a weak catalyst such as di(ammonium) hydrogen phosphate or ammonium formate, a moderate catalyst such as formic acid, ammonium sulphate, ammonium chloride or ammonium dihydrogen phosphate, or a strong catalyst such as phosphoric, sulphuric, sulphamic or hydrochloric acid. The amount of catalyst will generally be within the range 0.05 to 1% by weight of the resin solids.

In some cases, particularly where the fibres are to be used in the manufacture of paper, it may be desirable to incorporate an adhesion modifier into the resin. Such modifiers include certain inorganic oxyacid radicals which react with aldehydes. Examples of suitable radicals include sulphite, phosphite, and borate radicals.

When used as adhesion modifiers, such radicals are incorporated into the resin during the condensation of the amino or phenol compound with the aldehyde.

Alternatively adhesion modifiers, such as carbohydrates, particularly formose, may be incorporated into the resin solution before, during, or after condensation of the amino or phenol compound with the aldehyde. The incorporation of modifiers is further described in commonly assigned U.S. application Ser. No. 857,972 filed Dec. 5, 1977 now U.S. Pat. No. 4,202,959 and U.S. Pat. No. 4,172,057.

The resin is preferably fed to the spinning cup as a solution of the resin in a suitable solvent. Water is the preferred solvent where the resin is water soluble, but alternatively any solvent which is relatively volatile at the temperatures to which the spun fibres are heated by the hot, dry, air stream may be employed.

In order to improve the spinning properties of the resin it is preferred to include in the resin/catalyst mixture fed to the spinning cup a small amount of a dissolved thermoplastic polymer and/or a surfactant. Examples of suitable water soluble polymers include polyvinyl alcohol and poly ethylene oxide. The amount of thermoplastic polymer used is preferably 0.01 to 5% by weight of the thermosetting resin solids. While the thermoplastic may be incorporated before or during condensation of the amino and/or phenol compound with the aldehyde, it is conveniently added with the curing catalyst.

The liquid resin fed to the spinning cup preferably has a viscosity between 5 and 300 poise, preferably between 15 and 75 poise, at room temperature as measured by British Standard 1733 using cup B6. The viscosity may be adjusted, where the resin is supplied to the spinning cup as a solution, by concentration or dilution of the solution as necessary.

The spinning cup, which is mounted for rotation about a substantially vertical axis, is a hollow vessel having one or more spinning surfaces. For example the cup may be open-ended and the spinning surface comprises the end of the open wall thereof. Alternatively the cup wall may be provided with a plurality of spinning surfaces in the form of perforations. The size and number of perforations will be determined by the cup diameter and rotational speed: however typically for a 12 cm diameter cup rotating at 5000 to 10,000 rpm, 24 perforations of 3 mm width are suitable. The perforations are preferably rectangular in configuration and the resin solution feed rate and cup rotational speed are preferably adjusted so that the resin solution is spun from part of the perimeter of the perforations.

As mentioned above, in order to prevent premature curing of the resin and evaporation of the solvent, cold, humid, air is supplied to the interior of the cup from whence it is pumped, by rotation of the cup, along with the resin fibres. The fibres are thus entrained in the stream of cold, humid, air as they are spun from the spinning cup. While so entrained in the cold, humid environment the fibres are attenuated, partly by inertia and partly by the effect of the cold, humid, air stream. The fibres are preferably drawn out to a mean diameter of the order of 1 to 50 μm, particularly below 30 μm. To permit such attenuation it is necessary for the fibres to remain entrained in the cold, humid, air stream for some distance from the spinning cup. Generally they should be so entrained and not heated by contact with the stream of hot, dry, air until they have reached a distance of at least the diameter of the spinning cup from the axis of the cup.

The extent to which the fibres are attenuated depends on a number of factors, including the extent to which they remain entrained in a cold, humid environment, as indicated above. The stream of hot, dry, air will eventually mix with the cold, humid, air and dry the fibres thereby preventing further attenuation.

The extent of attenuation will therefore also depend on the relative velocities, positioning, temperature and humidity of the air streams.

In one embodiment of the invention, the stream of hot, dry, air is directed outwards from below the spinning cup. Thus hot, dry, air may be caused to flow from below the cup towards the bottom of the cup, which deflects it outwards. If necessary, means may be provided on the bottom of the cup (for example an axial fan and/or a radial propeller or the like) to ensure that the hot, air is deflected to form outwardly-flowing hot, dry air currents.

When the hot air stream is directed upwardly and outwardly from below the cup, the outwardly directed stream of cold, humid air thrown out of the cup with the attenuating fibres entrained therein should be supplemented by a downwardly directed stream of cold, humid, air from above the cup. In the absence of such a downwardly directed stream of cold, humid, air around the cup, the outwardly directed air stream having the fibres entrained therein emanating from the cup often gives rise to a torroidal vortex of cold, humid, air of somewhat greater diameter than the spinning cup and located in a plane just above the spinning plane i.e. the plane of the fibres as they are spun from the cup. In some cases the fibres may be caught up by this vortex and become entangled and/or thrown up on to the underside of the top of the enclosure in which the spinning operation is conducted where, because the fibres are still only partially dried and hence are of a somewhat adhesive nature, they adhere and so are not transported to the collection zone. Eventually such adhering fibres interfere with the satisfactory spinning of the rest of the resin.

In another embodiment the hot air stream is directed downwards from above the cup. This downwardly directed hot air stream deflects the outwardly directed stream of cold, humid, air having the fibres entrained therein downwards and hence avoids the formation of such a torroidal vortex. The downwardly directed stream of hot, dry, air is utilised in addition to, or instead of, the upwardly and outwardly directed stream of hot, dry air from beneath the spinning cup.

Therefore the stream of cold, humid, air emanating from the cup should be deflected downwards, whether the hot air is supplied from above or from below or from both above and below the cup. The stream of cold, humid, air emanating from the spinning cup should be deflected downwards to such an extent that the torroidal vortex is eliminated to such an extent that the fibres entrained in the cold, humid, air stream are not caught up in such a vortex. Where the cold, humid, air stream is deflected downwards by the downwardly directed hot air stream, increasing the flow rate of the hot, dry, air stream will reduce or eliminate completely such a vortex but at the same time will reduce the extent of attenuation of the fibres. However simple experimentation particularly aided by an inspection window in the casing of the spinning apparatus and suitable illumination, will reveal whether the fibres are being caught up in any vortex, while examination of the product will reveal whether the desired attenuation has been achieved. However where the design of the system is such that the downwardly directed hot air stream would deflect and mix with the outwardly directed cold, air stream too early (i.e. before the fibres have attenuated sufficiently), the hot air stream flowing downwards from above the spinning cup may be deflected outwardly by a subsidiary stream of cold, humid, air above the spinning cup. This subsidiary stream may have a downward component which causes some or all of the downward deflection of the stream of cold, humid, air having the fibres entrained therein. The process is conveniently set up by fixing the temperature, humidity and flow rate of the cold, humid air stream(s), the resin feed rate, and the rotational speed of the cup, and then adjusting the flow rate and temperature of the hot, dry, air to eliminate vortex formation and to give fibres having the desired degree of attenuation.

Where the hot, air stream is downwardly directed from above the cup, in some cases it may be found that a vortex is formed below the spinning cup. While it is not necessary to eliminate such a vortex, its removal may be desirable in some cases. It may be eliminated by the provision of an outwardly directed stream of air from below the cup and/or by the provision of a suitably shaped housing below the spinning cup to give streamlined flow of the air streams thereover.

The stream of hot, dry, air serves to dry the fibres and to transport them to the collection zone. The hot, dry, air may also serve to at least partially cure the resin. Further curing of the resin fibres may be effected, if desired, by heating, for example in an oven, at 100° to 250° C., preferably below 200° C. and typically at between 120° C. and 140° C., for a suitable period of time. The nature and amount of the catalyst, together with the spinning and post spinning heat treatment conditions will determine the degree of cure for any given resin. For some applications it may be desirable to only partially cure the resin. The degree of cure may conveniently be assessed by determining the proportion of fibre dissolved in water under specified conditions. A suitable procedure is as follows:

A sample (approx 5 g) of the dry fibre is accurately weighed and then digested with 200 ml of water for 2 hours at 50° C. The undissolved fibre remaining is recovered by filtration and dried at 100° C. in air for 2 hours and then reweighed. The (%) degree of cure is defined as $$\frac{\text{weight of recovered fibre}}{\text{original weight of fibre}} \times 100$$

The use of certain partially cured resin fibres in paper manufacture is described in commonly assigned U.S. patent application Ser. No. 109,906 filed Jan. 7, 1980.

Fibres produced by the process of the invention are of particular utility in paper manufacture either as the sole fibrous constituent or in admixture with cellulosic fibres, e.g. conventional mechanical or chemical pulp, or other synthetic fibrous materials, e.g. polyolefin fibres.

The invention is hereinafter described with reference to the accompanying drawings, wherein.

Figure 1:
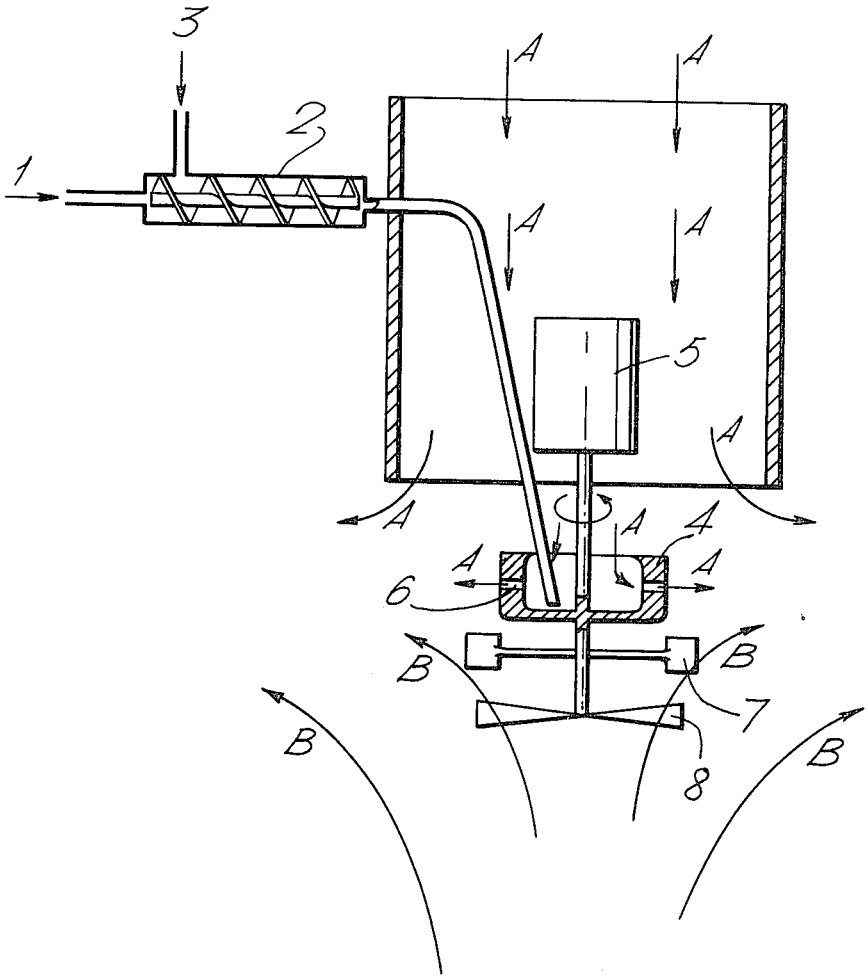
FIG. 1 illustrates, schematically, the process according to the invention for centrifugally spinning and collecting formaldehyde resin fibres by introducing a liquid resin (for example, an aqueous urea formaldehyde resin) into a rotating cup.

Referring to FIG. 1, aqueous UF resin of viscosity 5 to 300 poise, preferably 10 to 100 poise, more preferably 15 to 75 poise, is introduced at 1 into a mixer 2, where it is mixed with an aqueous solution of a resin-curing catalyst introduced at 3. (The addition of a spinning aid, such as polyethylene oxide solution, and/or of a surfactant, such as "Lissapol", to the mixer 2 is advantageous). From the mixer 2, the UF resin mixture is introduced onto the base of a rotating cup 4 driven by a motor 5. The resin spreads over the base and the wall of the cup 4 as a thin film, and is spun from apertures 6 in the wall of the rotating cup under such conditions as to produce a plurality of individual, separate fibres. These are allowed to attenuate or stretch to the diameter desired therefor, without drying or curing or disturbance from turbulent air, by first spinning them into a region of low temperature and high humidity. Such a region is provided by a downwardly-directed flow of cold, humid, air which partly flows through the apertures 6 with the fibres and which is partly deflected outwardly by the cup, to form outwardly directed currents of cold, humid air as shown by the arrows A. The pumping action caused by the rotation of the cup 4 causes the cold, humid air to be deflected outwardly with, and in the same manner and direction as, the fibres, thereby reducing the relative velocity between the cold, humid, air and the resin fibres during the attenuation and stretching of the resin fibres. In most cases, ambient air will be suitable.

When the desired fibre diameter has been attained, the resin fibres are dried and transported to a fibre-collecting point by suitable outwardly-directed currents of dry, hot air indicated by arrows B in FIG. 1. These currents B may be created by a radial propellor 7 and an axial fan 8 fitted to the bottom of the cup 4. The hot, dry, air is at a temperature such as to heat the fibres to between 50° C. and 100° C., for example about 65° C. or 70° C.

After the spun fibres leave the cup, they continue to be drawn out and attenuated or stretched into fibres of smaller diameter, but they are physically stabilised by the heat of the dry, hot air currents B, during their free flight from the cup, after they have attained the desired diameter but before they have a chance to develop into droplets or shot.

After collection, the fibres are cured and chemically stabilized by heating, during which the catalyst not only cures them but renders them insoluble in cold water. Suitable catalysts comprise acids or acid salts, for example sulphuric acid, formic acid, ammonium salts (for example ammonium sulphate), or mixtures thereof. The curing is carried out at above 100° C., preferably above 120° C.

Figure 2:
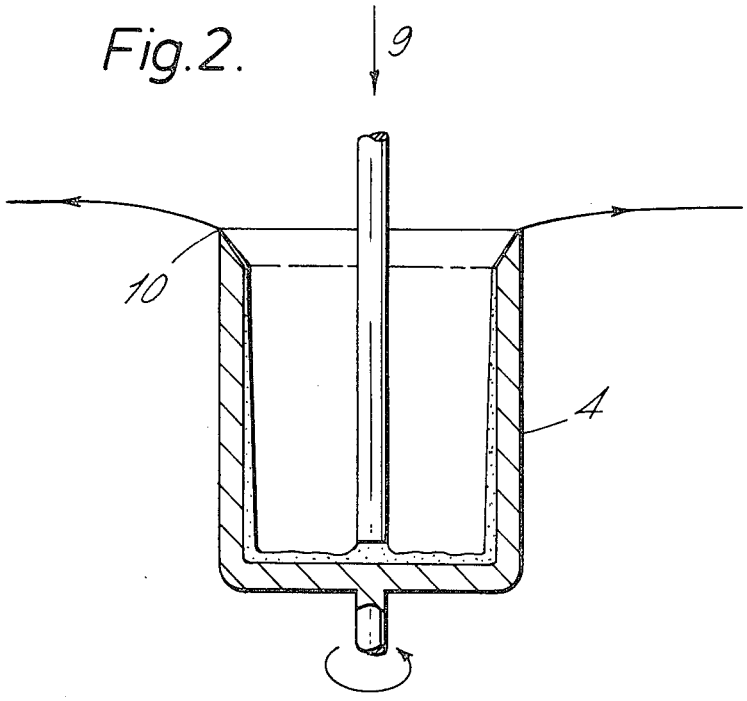
FIG. 2 illustrates one form of cup, in which the fibres are spun centrifugally from the upper lip of the cup.

One suitable cup design for use in the invention is illustrated diagramatically in FIG. 2 of the accompanying drawings. Liquid resin (e.g. a UF resin solution) is fed through 9 with a liquid catalyst to the bottom of the rotating cup 4; it flows radially across the cup and then up the walls of the cup, where flow irregularities are smoothed under the centrifugal forces operating in the rotating cup. At the correct flow rate, fibres are spun outwardly from the lip 10 of the cup. The height of the cup is such as to allow the flow rate to be smoothed and depends upon the diameter of the cup, its rotational speed, and the viscosity of the liquid resin being spun.

The diameter of the cup and its rotational speed can be varied over quite large ranges, and are adjustable to give the rates required by the process.

Figure 3:
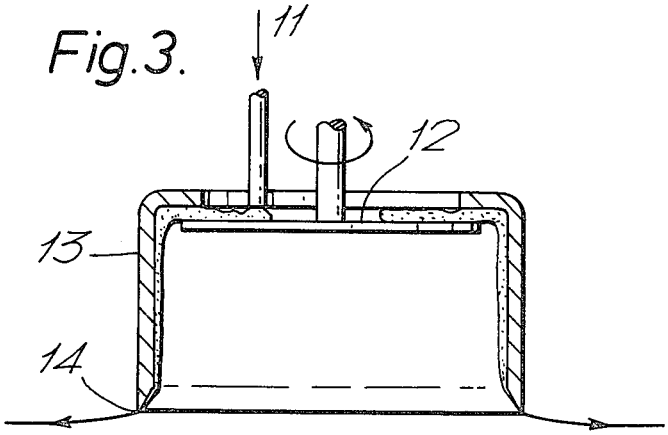
FIG. 3 illustrates an inverted cup, in which the fibres are spun centrifugally from the lower lip of the cup.

An alternative apparatus for use in the process of the invention is illustrated in FIG. 3, in which the liquid resin and catalyst are through 11 fed onto a rotating disc 12 surrounded by a downwardly-extend annular wall 13, the wall and the disc forming an inverted cup. The resin flows radially across the disc 12 and down the inner surface of the annular wall 13 where fibres are spun centrifugally outwards from the bottom lip 14 thereof.

The throughput of the cup designs illustrated in FIGS. 2 and 3 is limited by the fact that, above a certain critical resin flow-rate (which depends, inter alia, upon the diameter and depth of the cup, its rotational speed, and the viscosity of the resin), the resin tends to leave the rim of the cup as a two-dimensional sheet before breaking up into irregular fibres, instead of leaving the rim of the cup as individual, separate fibres. The effect of exceeding the critical resin flow-rate is illustrated in the Examples which follow hereunder.

Figure 4:
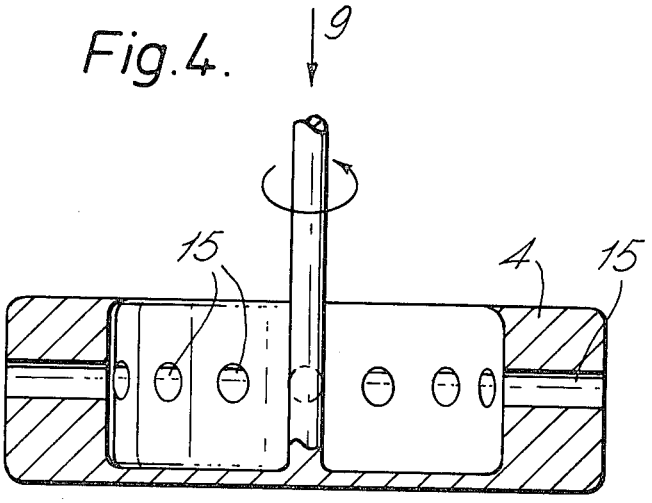
FIG. 4 illustrates another form of cup, in which the fibres are spun centrifugally through holes provided in the circumference of the cup.
Figure 4A:
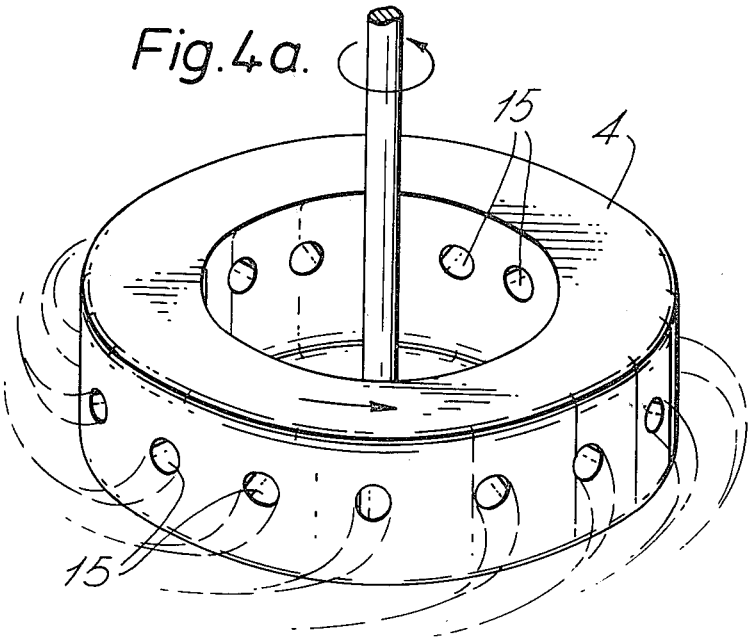
FIG. 4*a* shows the same cup in operation.

However, the limit to the resin flow-rate described above can be removed if the fibres are prevented from joining at the rim of the cup to form continuous two-dimensional liquid films. This can be achieved by the use of cups as shown in FIGS. 4 and 4*a*, in which the cup wall 4 is provided with a plurality of equidistantly-spaced holes 15 extending into the interior of the cup. The embodiments of FIGS. 4 and 4*a* are preferably operated at a resin flow rate such that the holes 15 are not completely filled with the liquid resin, but also allow the cold, humid, air to flow therethrough together with the resin. The resin spins from the surfaces of the holes 15 as a film which collapses to form a fibre which generally has an elliptical cross-section. The distance between adjacent holes 15 must be greater than that necessary to allow for the elastic expansion of the resin upon leaving the hole.

Figure 5:
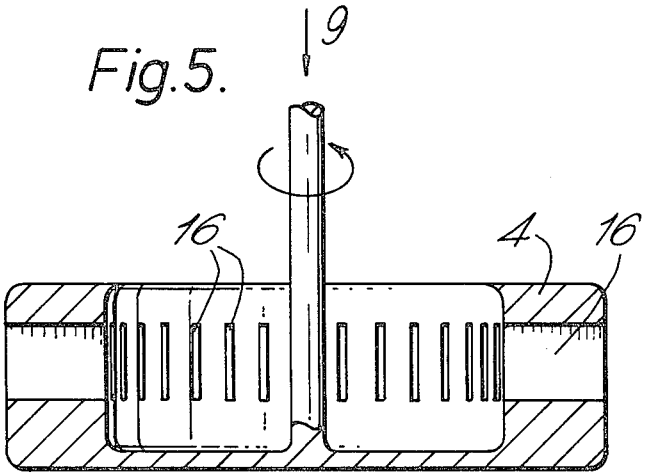
FIG. 5 illustrates another form of cup, in which the fibres are spun centrifugally through slots provided in the circumference of the cup.
Figure 5A:
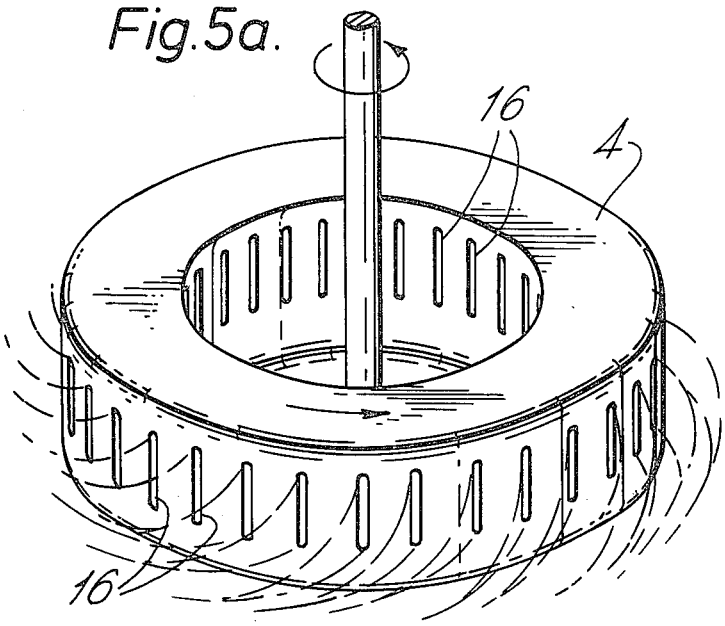
FIG. 5*a* shows the same cup in operation.

The holes 15 of FIGS. 4 and 4*a* may be replaced by equidistantly-spaced slots 16, as shown in FIGS. 5 and 5*a*.

Figure 6:
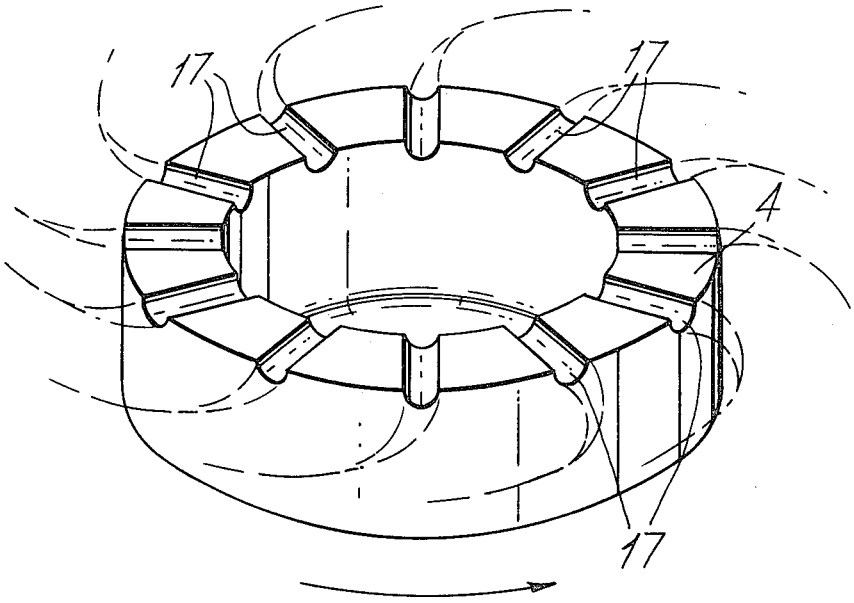
FIG. 6 illustrates an alternative form of cup, in which fibres are spun through grooves, serrations or the like provided in the upper rim of the cup.

Cups with grooved, scalloped, serrated or castellated rims 17, as shown in FIG. 6, work in the same manner as the holed or slotted cups of FIGS. 4, 4*a*, 5 and 5*a*, until the resin flowrate is such as to cause the resin to flood over the top of the rim of the cup. At such a high flow rate, the fibres will join together as a two-dimensional sheet and the cup will have reached its useful limit for the production of good quality fibres. However, with the holed or slotted cups of FIGS. 4, 4*a*, 5 and 5*a*, the useful limit is probably not reached until the holes or slots are full of liquid.

In the following Examples 1 to 9, experiments were carried out using aqueous urea formaldehyde resin, varying in viscosity from 15 poise to 300 poise. 3″-diameter cups and 5″-diameter cups of the types shown in FIGS. 2 and 4 were used, rotating at between 3000 rpm and 5000 rpm. In Examples 1, 2 and 4 to 6, the resin was not catalysed, and the physical quality of the fibres was merely inspected and judged at the collecting point. In Examples 3 and 7 to 9, the resin was catalysed, and the fibres were removed from the collecting point and cured and chemically stabilised as described.

The fibres were judged to be of good quality if the bulk of them were in the form of separate, individual fibres, or as fibres sufficiently loosely stranded so as not to impede their subsequent separation, and if they were substantially free of "shot" (i.e. non-fibrous formaldehyde-resin material of a size greater than the diameter of the thickest of the fibres). Good quality fibres also had a mean diameter between 1$\mu$ and 30$\mu$, preferably between 2$\mu$ and 20$\mu$, and an average strength of at least 50 mega-Newtons per square meter. The most obvious characteristic of poor quality fibres was the presence of a substantial amount of "shot".

EXAMPLE 1

"Aerolite 300" U/F resin supplied by Ciba-Geigy was used. ("Aerolite 300" is an aqueous U/F resin prepared by condensing a mixture of urea and formaldehyde in a F:U molar ratio of about 1.95:1, followed by concentration to a solids content of about 65% by weight. It has a viscosity, depending upon its age, of about 40 to 200 poise at room temperature, and a water tolerance of about 180%). The resin was adjusted to a viscosity of about 75 poise, by the addition of water, and then fed to the bottom of a 3″ diameter cup shaped according to FIG. 2, and rotating at a speed of 3000 rpm. At a feed rate of about 75 ml/minute, good quality fibre was produced, having an average diameter of about 15$\mu$. At a feed rate of 200 ml/minute, the resin was spun from the rim of the cup as a continuous two-dimensional sheet and gave poor quality fibres.

EXAMPLE 2

The experiment outlined in Example 1 was repeated using "Aerolite 300" diluted to about 25 poise viscosity and with 2% "Lissapol" solution added. Good fibrillation was obtained over a range of flow rates of about 60 ml/minute to about 190 ml/minute. At higher flow rates, the fibres were of poorer, unacceptable quality.

EXAMPLE 3

"Aerolite 300" resin, diluted to a viscosity of about 35 poise, was mixed with 6% by weight of a 2.4% aqueous solution of polyethylene oxide and 2% by weight of a 30% solution of ammonium sulphate in water, and then fed to a 24-holed 3″-diameter rotating cup of the type shown in FIG. 4. At a feed rate of about 75 ml/minute, good quality fibres of average diameter about 12$\mu$ were produced at a rotational speed of 5000 rpm. The fibres were removed from the collecting point, and cured by heating in an oven at between 120° C. and 140° C. for about 4 hours. This stabilized them chemically, and rendered them insoluble in cold water. Unlike Example 1, good fibrillation was still obtained at flow rates in excess of 12 Kg/minute. (Approx. 9 liters/minute).

EXAMPLE 4

"Aerolite 300" diluted with water to give a solution with viscosity 75 poise was spun from a 5"-diameter cup of the type shown in FIG. 2, and rotating at 3000 rpm. Good fibres were produced at rates between about 50 and 200 ml/minute.

EXAMPLE 5

The experiment outlined in Example 4 was repeated using "Aerolite 300" resin with a viscosity of about 15 poise. Good fibrillation was obtained at flow rates between about 100 and 250 ml/minute.

EXAMPLE 6

The experiment outlines in Example 4 was repeated, using "Aerolite 300" diluted to a viscosity of 25 poise with water, with the addition of 2% by weight of "Lissapol" solution. Good fibrillation was obtained at resin flow rates between about 100 and 250 ml/minute.

EXAMPLE 7

"Aerolite 300" resin, diluted with water to about 35 poise viscosity, was mixed with 6% by weight of a 2.4% solution of polyethylene oxide and 2% by weight of a 30% aqueous solution of ammonium sulphate. This was then fed to a 24-holed 5"-diameter rotating cup of the type shown in FIG. 4. At a speed of about 5000 rpm, good fibres of average diameter about 10μ were obtained at a feed rate of about 75 ml/minute. As in Example 3, good fibrillation was also observed at very much higher feed rates. The fibres were removed from the collecting point, and cured by heating at between 120° C. and 140° C. for about 4 hours. This stabilized them chemically, and rendered them insoluble in cold water.

EXAMPLE 8

The following table sets out the formulation of different resins and the conditions which were used to produce good quality fibres; in all cases a 3" cup with 24 holes was used at a rotation speed of 4500 rpm. The hot air temperature was 75° C. All the resins contained 1.6% by weight of a 2.4% polyethylene oxide solution and 7% by weight of a 30% ammonium sulphate solution. All the percentages hereunder are percentages by weight.

| | Resin | Resin Viscosity (poise) | Resin Feed Rate (g/min) |
|---|---|---|---|
| 1. | F:U ratio 1.95:1 Solids content 55% with 10% glycerol added | 25 | 78 |
| 2. | As (1) except 10% ethylene glycol instead of glycerol | 15 | 78 |
| 3. | F:U ratio 1.95:1 Solids content 65%, 5% melamine added | 50 | 78 |
| 4. | As (3) but 10% melamine added to the resin, | 50 | 78 |
| 5. | As (4) but melamine substituted by 10% resorcinol added to the resin | 50 | 78 |
| 6. | As (4) but melamine substituted by 10% cresol added to the resin | 50 | 78 |
| 7. | As (4) but melamine substituted by 10% phenol added to the resin | 50 | 78 |

The following UF resins were fibrillated using a 5" diameter cup with 24 holes, rotating at 4500 rpm and using the same catalyst, spinning aid and hot air temperature as above.

| Resin | Resin Viscosity (poise) | Resin Feed Rate (g/min) |
|---|---|---|
| F:U ratio 1.2:1 | 35 | 50 |
| F:U ratio 1.6:1 | 50 | 50 |

All fibres produced were of good quality, and were cured at 120° C. for 3 hours.

The fibres produced in accordance with the present invention are particularly useful for use in paper-making, as described in commonly assigned U.S. patent application Ser. No. 068,724 filed Aug. 22, 1979.

Figure 7:
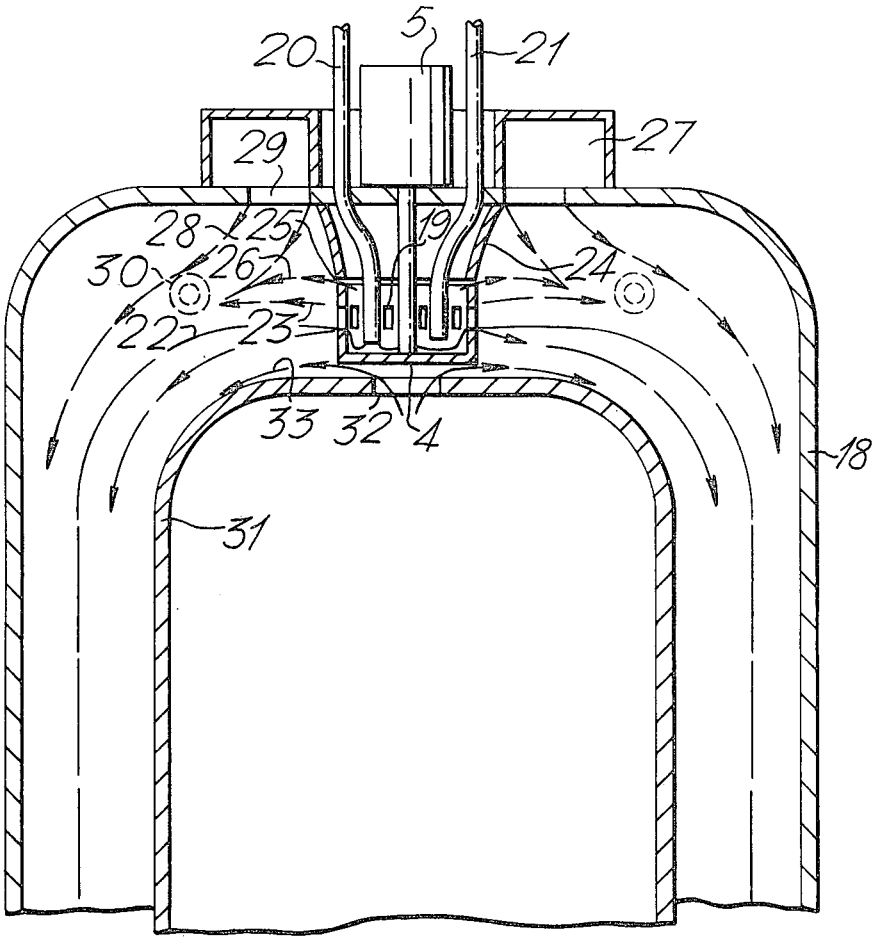
FIG. 7 illustrates another embodiment of the invention and is a vertical section through the apparatus.

In the embodiment illustrated in FIG. 7 the spinning apparatus has an outer casing 18 on the top of which is mounted the motor 5 driving a shaft carrying the spinning cup 4. The cup 4 has a vertical side wall in which there is provided a plurality of rectangular perforations 19. Resin solution, in admixture with a solution of a curing catalyst, and optionally a soluble thermoplastic polymer, is fed to the cup 4 via a feed pipe 20. Cold, humid, air is fed to the cup via an air feed pipe 21. On rotation of the cup, e.g. at 5000–10,000 rpm, the resin solution is spun from the lower edge of the perforations 19 as fibres 22 entrained in an outwardly directed stream 23 of cold, humid, air pumped from the supply 21 through the perforations 19 by rotation of the cup 4. Between the top of cup 4 and casing 18 is a shroud 24 surrounding the drive shaft and feed pipes 20, 21. A small gap 25, for example about 1 mm, is left between the bottom of shroud 24 and the top of cup 4. Rotation of cup 4 also causes an outwardly directed stream 26 of the cold, humid, air to issue from gap 25. Hot, dry, air is pumped to a plenum chamber 27 on the top of the casing 18 from whence it flows as a downwardly directed stream 28 through an annular orifice 29. This stream 28 of hot, dry, air is deflected outwardly by the stream 26 of cold, humid, air issuing from gap 25 and impinges on the stream 23 of cold, humid, air issuing from the perforation 19 of the cup, deflecting the stream 23 downwards thereby eliminating the torroidal vortex 30 (shown dotted) which would form in the absence of the downwardly directed stream 28 of air. The shroud 24 may, if desired, be provided with vanes (not shown) to deflect the hot, dry, air stream outwardly thus augmenting the radial deflection given by stream 26.

While the fibres 22 are entrained in the cold, humid, air stream 23, drying is retarded so that they are attenuated, partly by the effect of the cold, humid, air stream 23.

The stream of hot, dry, air 28 eventually mixes with the stream of cold, humid, air 23, dries the fibres 22, and transports them to a conveyor (not shown) at the bottom of the spinning apparatus.

Beneath cup 4 there is provided a housing 31 which serves to streamline the air flow. A hole 32 is provided in housing 31 beneath cup 4. The rotating cup 4 acts as an air pump drawing air in through hole 32 and expelling it radially as a stream 33. This air stream prevents the formation of a vortex below the spinning cup 4.

Figure 8:
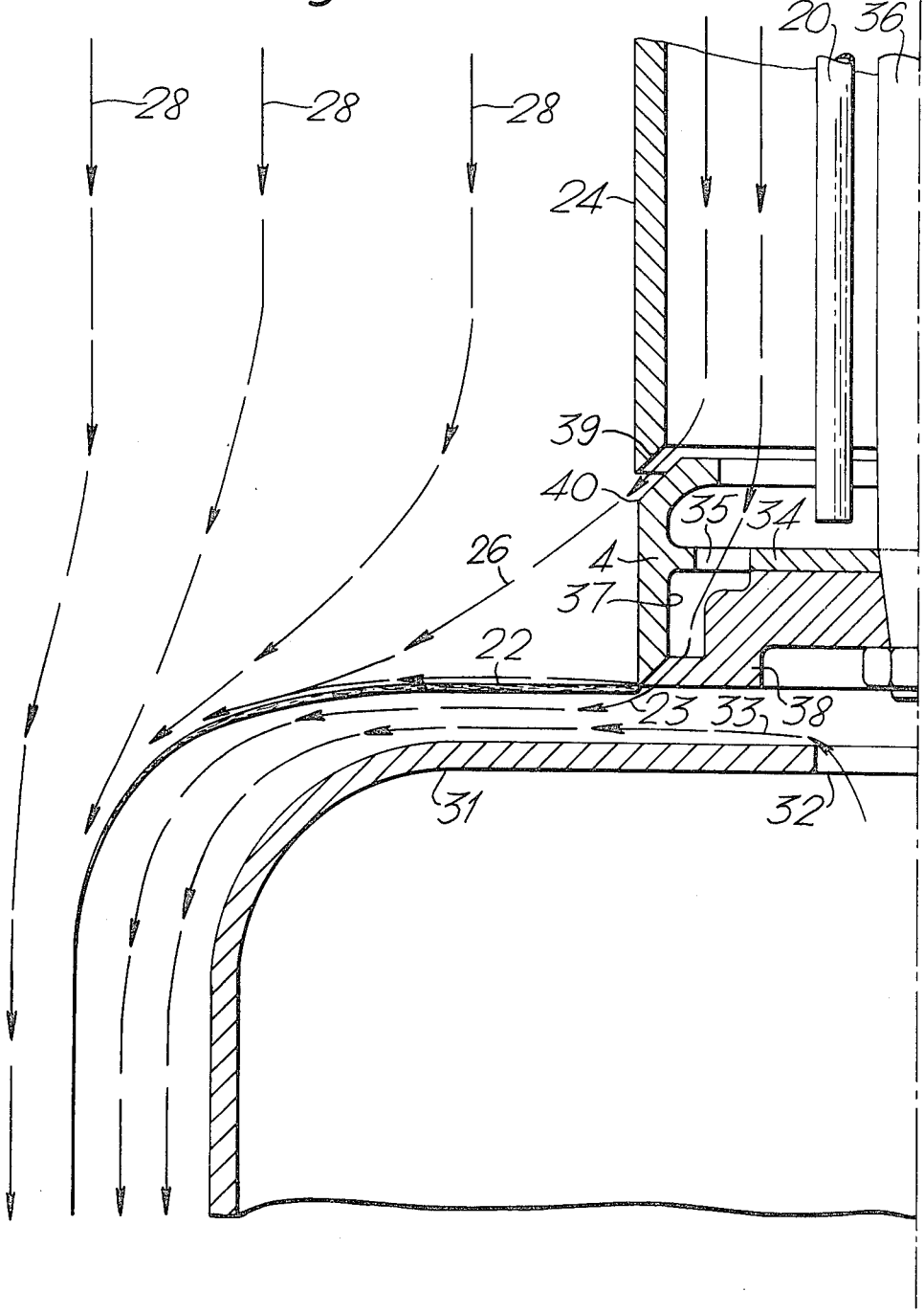
FIG. 8 illustrates a further embodiment and is a vertical section through part of the apparatus.

In FIG. 8 the spinning cup 4 comprises a hollow vessel divided into upper and lower portions by an integral plate 34 having a plurality of perforations 35 therein. The cup is driven by a shaft 36. The resin feed supply tube 30 extends through the open upper end of cup 4 and supplies the resin on to plate 34 from whence it passes, through perforations 35, on to the interior wall 37 of the lower portion of cup 4. The resin flows down wall 37 and is spun as fibres 22, by centrifugal force, from the lower edge of wall 37.

Cup 4 is mounted for rotation within an enclosure, not shown, carrying a stationary shroud 24 surrounding the drive shaft 36 and the resin supply tube 20. Cold, humid, air is pumped down the interior of shroud 24. Some of the cold, humid, air flows into the upper portion of cup 4, through perforations 35 and out of the bottom of the cup as an outwardly directed air stream 23 having the fibres 22 entrained therein. A deflector 38 mounted under and rotatable with plate 34 is provided to limit the flow of cold, humid, air and to direct it outwardly to entrain fibres 22.

The remainder of the cold, humid, air flows outwardly as a stream 26 from between the bottom surface 39 of shroud 24 and the top surface 40 of cup 4. These bevelled surfaces 39, 40 impart a downward component to the air stream 26 flowing from therebetween.

Outside cup 4, but within the enclosure, is a downwardly directed stream 28 of hot, dry, air. This stream 28 is deflected outwardly by the air stream 26 so that it does not meet the cold air stream 23 flowing out of the bottom of cup 4 with the fibres 22 entrained therein until the fibres have been attenuated to the desired degree. As cold air stream 26 has a downward, as well as outward, component it also served to deflect the cold air stream 23 flowing out of the bottom of cup 4 downwards thus eliminating vortex formation.

As in the embodiment of FIG. 7 a housing 31 is provided to smooth the air flows below the cup 4. This housing 31 is provided with an aperture 32 from which air is drawn, and thrown outwardly by the pumping action of the rotation of cup 4, as an air stream 33.

The invention is further illustrated by the following example.

EXAMPLE 9

An aqueous solution of a urea/formaldehyde resin having a urea:formaldehyde ratio of 1:2 and a solids content of 65% by weight was mixed with 16 ml, per 100 g of the resin solution, of an aqueous solution containing 2.5% by weight of a polyethylene oxide of mean molecular weight 600,000 and 0.44% by weight of ammonium sulphate as curing catalyst. The resultant solution, which had a viscosity of about 20 poise at room temperature, was spun into fibres using apparatus of the type shown in FIG. 7 but in which housing 31 was omitted.

The solution was fed at 20° C. at a rate of 80 ml/minute (approx. 75 g of resin per minute) to the spinning cup which had a diameter of 12 cm and 24 rectangular perforations of 3 mm width and 5 mm height in its sidewall. The rotational speed of the cup was 7000 rpm.

Air at 30° C. and 70% relative humidity was fed to the cup at a rate of approximately 63 $m^3$/hour. Dry air at 170° C. (obtained by heating ambient air to 170° C. without any drying step) was fed to the plenum chamber at 185 $m^3$/hr from whence it flowed via an annular gap of 20 cm outside diameter and 4 cm width, into the spraying chamber which had a diameter of 1.2 m. The resultant stream of hot, dry, air deflected the stream of cold, humid, air emanating from the spinning cup perforations and from the gas between the shroud and the top of the cup, downwards and carried the fibres, while drying them, to the collection zone. The resultant fibres had an average diameter of about 8 μm.

The process was repeated varying the spinning conditions as set out in the following table.

| Run | Resin Feed Rate g/min | Cup Speed rpm | Hot Air Flow $m^3$/hr | Hot Air Temp °C. | Remarks |
|---|---|---|---|---|---|
| 1 | 75 | 7000 | 185 | 170 | Good fibres |
| 2 | 110 | 7000 | 170 | 216 | Good fibres |
| 3 | 125 | 7000 | 170 | 181 | Good fibres |
| 4 | 100 | 7000 | 60 | 170 | Fibres stuck to roof of vessel. |
| 5 | 75 | 6000 | 180 | 165 | Good fibres |
| 6 | 250 | 7500 | 365 | 190 | Fibres insufficiently attenuated. |
| 7 | 300 | 7500 | 190 | 250 | Fibres very slightly damp |
| 8 | 400 | 7500 | 200 | 250 | Fibres damp and sticky |
| 9 | 230 | 8000 | 190 | 190 | Fibres slightly damp and sticky tending to stick on vessel wall. |
| 10 | 190 | 12000 | 200 | 216 | Fibres dry but some hanging on vessel wall. |

In run 4 it is seen that the hot air flow rate was insufficient to prevent the fibres from being flung onto the vessel roof. In run 6 the hot air flow rate was too great and did not permit the fibres to remain entrained in the cold humid, air stream for a sufficient time.

I claim:

1. A process for the manufacture of fibres from a thermosetting formaldehyde resin comprising feeding the resin together with a resin-curing catalyst, which at temperatures above 100° C. will cure and chemically stabilise the resin and render it insoluble in cold water, in liquid form into a spinning cup rotating about a substantially vertical axis, feeding cold, humid, air into the cup, the temperature and humidity of the air being such that it inhibits drying and reaction of the resin/catalyst mixture whilst the cup, the rotation of the cup causing the resin/catalyst mixture to flow as an even film over the inner surface of the cup and to be spun centrifugally from the outer wall of the cup in the form of individual separate fibres entrained in an outwardly directed stream of said cold, humid, air within which said fibres attenuate until they have achieved the desired diameter, contacting the fibres with a stream of hot, dry, air at a temperature such as to dry the attenuated fibres and to transport them to a collecting zone, and collecting the dry fibres from the collecting zone.

2. A process according to claim 1 in which the outwardly directed stream of cold, humid, air entraining the attenuating fibres is deflected downwards by an air stream flowing downwards from above the cup whereby entanglement of the fibres in a torroidal vortex of said cold, humid, air is avoided.

3. A process according to claim 1 in which the stream of hot, dry, air is directed downwardly from above the cup.

4. A process according to claim 3 in which the stream of hot, dry, air is deflected outwards by a subsidiary outwardly directed stream of cold, humid, air above the spinning cup.

5. A process according to claim 4 in which the subsidiary outwardly directed stream of cold, humid, air also has a downward component.

6. A process according to claim 3 in which an outwardly directed stream of air is provided from below the spinning cup.

7. A process according to claim 1 in which fibres are spun from part of the perimeter of perforations in the wall of the spinning cup with the outwardly directed stream of cold, humid, air that entrains the fibres flowing through the remainder of the perforations.

8. A process according to claim 1 in which the fibres are spun from an aqueous ureaformaldehyde resin solution.

9. A process according to claim 1 in which the fibres are spun from an aqueous solution containing the formaldehyde resin and polyethylene oxide.

10. A process according to claim 1 in which the collected dry fibres are cured and chemically stabilised by heating them at above 100° C. until they are insoluble in cold water.

* * * * *